US012575618B1

(12) United States Patent
Dai et al.

(10) Patent No.: US 12,575,618 B1
(45) Date of Patent: Mar. 17, 2026

(54) UNDERGARMENT

(71) Applicant: Guangzhou Realwill Technology Co., Ltd., Guangzhou (CN)

(72) Inventors: Wei Dai, Guangzhou (CN); Lixin Chang, Guangzhou (CN); Chunyan Gan, Guangzhou (CN)

(73) Assignee: Guangzhou Realwill Technology Co., Ltd., Guangzhou (CN)

( * ) Notice: Subject to any disclaimer, the term of this patent is extended or adjusted under 35 U.S.C. 154(b) by 0 days.

(21) Appl. No.: 19/090,323

(22) Filed: Mar. 25, 2025

(30) Foreign Application Priority Data

Mar. 14, 2025 (CN) ..... 202520456167.2

(51) Int. Cl.

| | |
|---|---|
| ***A41C 3/00*** | (2006.01) |
| ***A41C 3/02*** | (2006.01) |
| ***A41C 3/12*** | (2006.01) |
| ***A44B 19/30*** | (2006.01) |

(52) U.S. Cl.
CPC ..... *A41C 3/0057* (2013.01); *A41C 3/0028* (2013.01); *A41C 3/02* (2013.01); *A41C 3/122* (2013.01); *A44B 19/305* (2013.01)

(58) Field of Classification Search
CPC ..... A41C 3/0057; A41C 3/0028; A41C 3/02; A41C 3/1212
See application file for complete search history.

(56) References Cited

U.S. PATENT DOCUMENTS

| | | | | |
|---|---|---|---|---|
| 6,165,045 | A * | 12/2000 | Miller | A41C 3/0057 450/17 |
| 7,690,965 | B2 * | 4/2010 | Falla | A41C 3/0014 450/39 |
| 8,690,634 | B2 * | 4/2014 | Heath | A41C 3/0057 450/40 |
| 9,480,287 | B2 * | 11/2016 | Black | A41C 3/0057 |
| 9,999,262 | B2 * | 6/2018 | Angelino | A41B 9/06 |
| 10,660,377 | B2 * | 5/2020 | Randall | A41C 3/14 |
| 10,993,482 | B2 * | 5/2021 | Raymond | A41C 3/0057 |
| 11,464,261 | B2 * | 10/2022 | Der Hoeven | A41C 3/12 |
| 11,684,092 | B2 * | 6/2023 | Roddis | A41C 3/0057 2/243.1 |
| 2010/0297912 | A1 * | 11/2010 | Falla | A41B 17/00 450/39 |

(Continued)

FOREIGN PATENT DOCUMENTS

CN 211211475 U 8/2020

*Primary Examiner* — Gloria M Hale

(57) ABSTRACT

The present application discloses an undergarment including: an undergarment body made of elastic fabric; a zipper; side support panels configured to provide lateral lifting force; and positioning stays configured to provide lower periphery constraints. The undergarment body is provided with two cup portions. The zipper is disposed on the undergarment body between the two cup portions, which when unfastened, opens the undergarment body. The side support panels are disposed on the undergarment body at outer peripheries of the cup portions. The positioning stays are arranged on the undergarment body below the cup portions. This undergarment achieves visual slimming of larger bust profiles while maintaining natural contour aesthetics, exhibiting dual applicability for both athletic and daily wear.

13 Claims, 6 Drawing Sheets

(56) References Cited

U.S. PATENT DOCUMENTS

| | | | | |
|---|---|---|---|---|
| 2016/0044971 | A1* | 2/2016 | Randall | A41C 3/142<br>450/39 |
| 2021/0015179 | A1* | 1/2021 | Raymond | A41C 3/0092 |
| 2021/0251307 | A1* | 8/2021 | Raymond | A41C 3/0057 |

* cited by examiner

UNDERGARMENT

CROSS REFERENCE TO RELATED APPLICATIONS

The present disclosure claims the priority of Chinese Patent Application No. 2025204561672 filed on Mar. 14, 2025 before CNIPA. All the above are hereby incorporated by reference in their entirety.

TECHNICAL FIELD

The present disclosure relates to the technical field of undergarment, and in particular, to an undergarment.

BACKGROUND

Due to the physiological characteristics of females, significant breast movement occurs during fitness activities, which may lead to breast sagging, interfere with exercise performance, and cause post-exercise discomfort. Consequently, there is an increased demand for functional undergarments that can secure the breasts and prevent breast movement.

As disclosed in Chinese Patent CN211211475U, the undergarment employs an elastic fabric made of nylon and cotton blend. Elastic edging along the periphery and an elastic band at the bottom band enhance body conformity, preventing exposure and displacement during movement while improving shock absorption. However, women often wear sports bras for daily use beyond fitness activities, thereby requiring additional functionalities such as making larger breasts appear thinner, smaller, and maintaining an attractive breast shape. The aforementioned sports bra adopts a full-compression approach to secure the breasts and mitigate movement. Although it can make the breasts appear flattened into a uniform circular shape to achieve a thinner and smaller visual effect, this comprehensive compression design inevitably compromises breast contour aesthetics.

SUMMARY

To overcome at least one of defects of the aforementioned prior art, provided in the present disclosure is an undergarment. This undergarment achieves visual slimming of larger bust profiles while maintaining natural contour aesthetics, exhibiting dual applicability for both athletic and daily wear.

The present application adopts the following technical solutions to address the problems:

An undergarment, including:

an undergarment body made of elastic fabric, the undergarment body being provided with two cup portions;

a zipper disposed on the undergarment body and positioned between the two cup portions, the zipper when unfastened being configured to open the undergarment body;

side support panels configured to provide lateral lifting force, the side support panels disposed on the undergarment body and positioned at outer peripheries of the cup portions; and positioning stays configured to provide lower periphery constraints, the positioning stays disposed on the undergarment body and located below the cup portions.

In some implementations, the side support panels are made of elastic fabric, and the side support panels are fixedly attached to an outer surface of the undergarment body.

In some implementations, the side support panels are glued to the undergarment body.

In some implementations, upper ends of the side support panels are connected at the connection with the shoulder strap of the undergarment body; lower ends of the side support panels are connected to a lower edge of the undergarment body; and a lateral side of the lower ends of the side support panels extends to the zipper.

In some implementations, an edge of the side support panels proximate to the cup portions extends in a curvilinear contour.

In some implementations, the positioning stays are fixedly attached to an inner surface of the undergarment body, and the positioning stays are positioned within a coverage area of the side support panels on the undergarment body.

In some implementations, the undergarment body includes a surface elastic fabric and an inner elastic fabric, the surface elastic fabric and inner elastic fabric being adhesively bonded via an elastic adhesive layer; the elastic adhesive layer includes a frame portion and lateral binding portions; the frame portion extends along an edge of the undergarment body and includes an upper elastic edge and a lower elastic edge; upper ends of the lateral binding portions are connected to the upper elastic edge; lower ends of the lateral binding portions are connected to the lower elastic edge; and the lateral binding portions are configured in an inclined orientation with upper ends extending toward an anterior chest region and lower ends extending toward a posterior waist region.

In some implementations, the elastic adhesive layer further includes arc-shaped lateral support elastic portions; upper ends of the arc-shaped lateral support elastic portions are connected to the upper elastic edge; lower ends of the arc-shaped lateral support elastic portions are connected to the lower elastic edge; and the arc-shaped lateral support elastic portions are positioned within a coverage area of the side support panels on the undergarment body.

in some implementations, the elastic adhesive layer further includes posterior shoulder strap elastic portions; upper ends of the posterior shoulder strap elastic portions are connected at the connection with the shoulder strap of the upper elastic edge; and lower ends of the posterior shoulder strap elastic portions are connected to the lower elastic edge.

In some implementations, the cup portions are provided with compact cups. The shape of the compact cup can be in the shape of a rabbit ear or a flower petal or a teardrop, etc.

In some implementations, the undergarment further includes an inner padding positioned inward of the zipper, a lateral edge of the inner padding being connected to a side of the undergarment body at the zipper.

In some implementations, the undergarment further includes an adjustment buckle connected to the undergarment body and positioned between the zipper and the inner padding.

In some implementations, the zipper includes a slider and two zipper straps, the two zipper straps are respectively connected to the undergarment body, the slider is configured to operate engagement/disengagement of zipper teeth of the two zipper straps, the slider includes a slider body provided with a through-hole and a Y-shaped channel for passage of the zipper straps, the through-hole is in fluid communication with the Y-shaped channel; a pull tab is provided with a pivot shaft rotationally mounted on the slider body, the pivot shaft is provided with an eccentric protrusion, a locking element is elastically deformable, an end of the locking element is connected to the slider body, an opposite end of the locking element is provided with a locking prong traversing the through-hole, the locking prong is configured to engage/disengage the zipper straps, and the eccentric protrusion pushes against the locking element to induce elastic deformation of the locking element to disengage the locking prong from the zipper straps thereby achieving unlocking upon rotation of the pull tab relative to the slider body to a preset angle.

In some implementations, the slider body includes a first wing plate, a second wing plate, and a guide post connecting frontal ends of the first wing plate and the second wing plate to form the Y-shaped channel; the guide post is provided with a slot for insertion and fixed connection of an end of the locking element; the through-hole is disposed on the first wing plate; the first wing plate is further provided with two spaced constraint assemblies for constraining the pivot shaft; the locking element is positioned between the two constraint assemblies; each constraint assembly comprises two constraint prongs spaced apart; the pivot shaft is threaded between the two constraint prongs of each constraint assembly; and upper ends of the two constraint prongs are elastically converged to restrict disengagement of the pivot shaft.

In summary, the undergarment provided by the present application has the following technical effects:

The undergarment employs a front-mounted zipper and an elastic fabric undergarment body to form an immovable force-bearing band between two cup portions through the zipper's non-elastic property. This compresses and visually slims the breasts while preserving space in the breast region to form lifting, shaping, and support through the coordinated action of the cup portions, side support panels 4, and positioning stays 5. Consequently, the undergarment simultaneously delivers a visually slimming effect for larger breasts while maintaining natural breast contour aesthetics, the front-mounted zipper also facilitates the user's wearing. Other beneficial effects are exhibited in specific embodiments.

Figure 1:
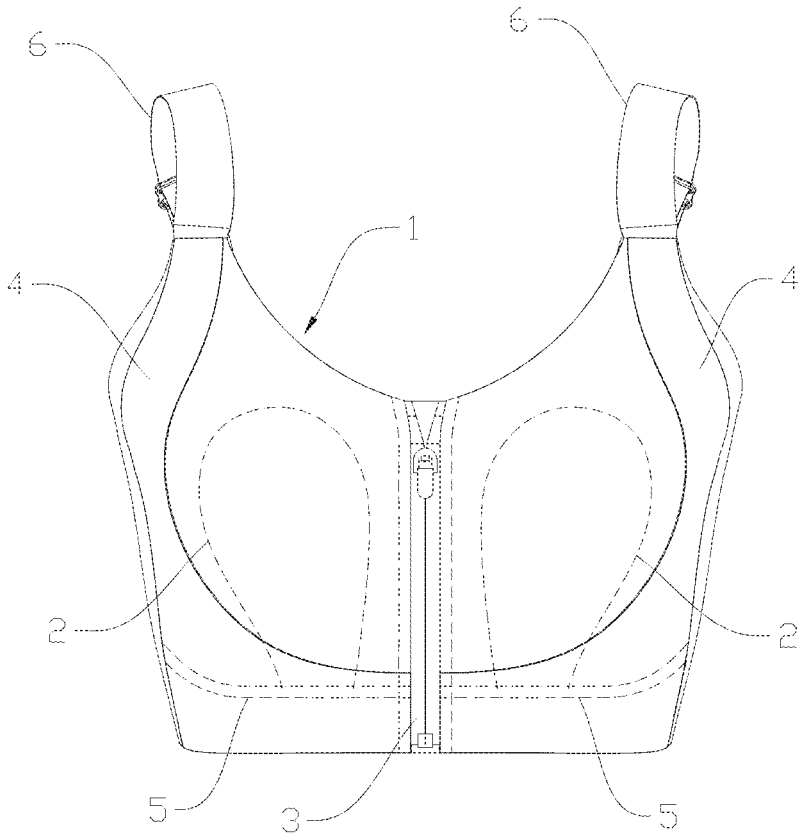
FIG. 1 is a schematic structural diagram illustrating a front view of the undergarment according to an embodiment of the present application.

The meanings of the reference numerals are as follows: 1 Undergarment body; 11 Surface elastic fabric; 12 Inner elastic fabric; 13 Elastic adhesive layer; 131 Frame portion; 1311 Upper elastic edge; 1312 Lower elastic edge; 132 Lateral binding portion; 133 Arc-shaped lateral support elastic portion; 134 Posterior shoulder strap elastic portion; 2 Cup portion; 3 Zipper; 31 Slider; 311 Slider body; 3111 Through-hole; 3112 Y-shaped channel; 3113 First wing plate; 3114 Second wing plate; 3115 Guide post; 3116 Slot; 3117 Constraint assembly; 3118 Constraint prong; 3119 Bayonet groove; 312 Pull tab; 3121 Pivot shaft; 3122 Eccentric protrusion; 313 Locking element; 3131 Locking prong; 3132 T-shaped foot; 4 Side support panel; 5 Positioning stay; 6 Shoulder strap; Inner padding; 8 Adjustment buckle.

DETAILED DESCRIPTION

For a better understanding and implementation, the technical solutions in the embodiments of the present disclosure are clearly and completely described below in conjunction with the attached drawings of the present disclosure.

In the description of the present disclosure, it is to be noted that the terms "up", "down", "front", "back", "left", "right", "vertical", "horizontal", "top", "bottom", "inside", "outside" and other orientation or position relationships are based on the orientation or position relationships shown in the attached drawings. It is only intended to facilitate description of the present disclosure and simplify description, but not to indicate or imply that the referred device or element has a specific orientation, or is constructed and operated in a specific orientation. Therefore, they should not be construed as a limitation of the present disclosure.

Unless otherwise defined, all terms including technical and scientific terms used herein have the same meaning as commonly understood by those skilled in the art to which the present disclosure belongs. The terms used herein in the specification of the present disclosure are used only to describe specific embodiments and are not intended as a limitation of the disclosure.

Figure 2:
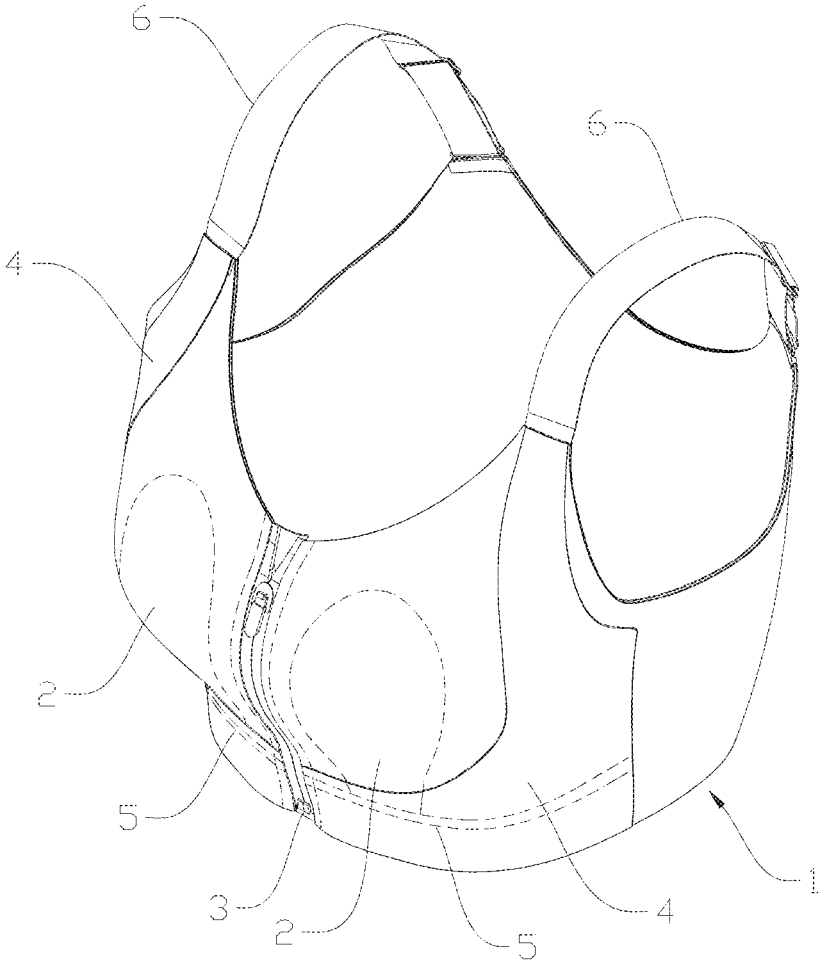
FIG. 2 is a schematic structural diagram illustrating a perspective view of the undergarment according to an embodiment of the present application.

With reference to FIGS. 1 and 2, disclosed in the present disclosure is an undergarment including: an undergarment body 1, a zipper 3, two side support panels 4, two positioning straps 5, two shoulder stays 6, an inner padding 7, and an adjustment buckle 8. The undergarment body 1 is made of elastic fabric or, in certain embodiments, a highly resilient and breathable textile. The undergarment body 1 is formed with two cup portions 2 arranged in bilateral symmetry. In certain embodiments, the cup portions 2 are configured as rabbit-ear-shaped compact cups to utilize their lightweight properties and anti-nipple-protrusion function. The two shoulder straps 6 are spaced apart and connected to the undergarment body 1. The shoulder straps 6 are, in certain embodiments, configured as adjustable retractable shoulder straps 6, thereby providing adaptable positioning to accommodate varying breast heights and broaden user compatibility. Alternatively, the shoulder straps 6 may be integrally formed with the undergarment body 1, where the fabric of the undergarment body 1 extends from the frontal region to the dorsal region to create a cross-shoulder configuration. The zipper 3 is front-mounted in the undergarment. The zipper 3 is disposed on the undergarment body 1 and positioned between the two cup portions 2. The zipper 3, when unfastened, is configured to open the undergarment body 1, thereby facilitating user wearing. The two side support panels 4 are disposed on the undergarment body 1. Each side support panel 4 is respectively positioned at the outer periphery of one cup portion 2. The side support panels 4 are configured to provide lateral lifting force. Two positioning stays are located on a front of the undergarment body under said brassiere cup position for supporting each one of a wearer's breasts. The positioning stays 5 are configured to provide breast cup lower periphery constraints to contain each breast of a wearer. The inner padding 7 is positioned inward of the zipper 3. A lateral edge of the inner padding 7 is connected to one side of the undergarment body 1 at the zipper 3. The inner padding 7 is configured to isolate the zipper 3, thereby preventing the zipper 3 from contacting the user's skin and avoiding pinch injuries. The adjustment buckles 8 may be provided in multiple numbers. The multiple adjustment buckles 8 extend along the length direction of the zipper 3. The adjustment buckles 8 are connected to the undergarment body 1 and positioned between the zipper 3 and the inner padding 7. The specific structure of the adjustment buckles 8 may adopt any existing technical solution (for example, including an S-shaped clasp and two fabric strips, or a figure-9 clasp and two fabric strips, or a back clasp structure used in existing undergarments). During wearing, the adjustment buckles 8 can be first utilized to preliminarily tighten the undergarment body 1, providing a pre-fastening function, before closing the zipper 3 to further facilitate wearing. Based on the positioning of the adjustment buckles 8 between the zipper 3 and the inner padding 7, the adjustment buckles 8 achieve concealed placement while preventing direct contact with the wearer's skin.

In alternative embodiments, the cup portions 2 may adopt a cup-free configuration or incorporate other compact cup configurations (such as teardrop-shaped or petal-shaped designs).

In the aforementioned solution, the zipper 3 possesses non-elastic properties while the undergarment body 1 exhibits elastic properties. During wearing, the elastic contraction of the undergarment body 1 utilizes the non-elastic characteristic of the zipper 3 to form an immovable force-bearing band between the two cup portions 2. This compresses and visually slims the breasts while creating a predefined volumetric space in the breast region through the coordinated action of the cup portions 2, side support panels 4, and positioning stays 5. Specifically, the side support panels 4 provide lateral lifting force; the positioning stays 5 establish lower periphery constraints; the centrally positioned zipper 3 generates medial traction; and this integrated mechanism concentrates breast tissue within the predefined volumetric space during compression, achieving prevention of inter-breast compression, resistance to breast sagging, lifting and shaping of breast contours, and elimination of breast displacement. Consequently, the undergarment simultaneously delivers a visually slimming effect for larger breasts while maintaining natural breast contour aesthetics, rendering it suitable for both athletic and daily applications.

Figure 3:
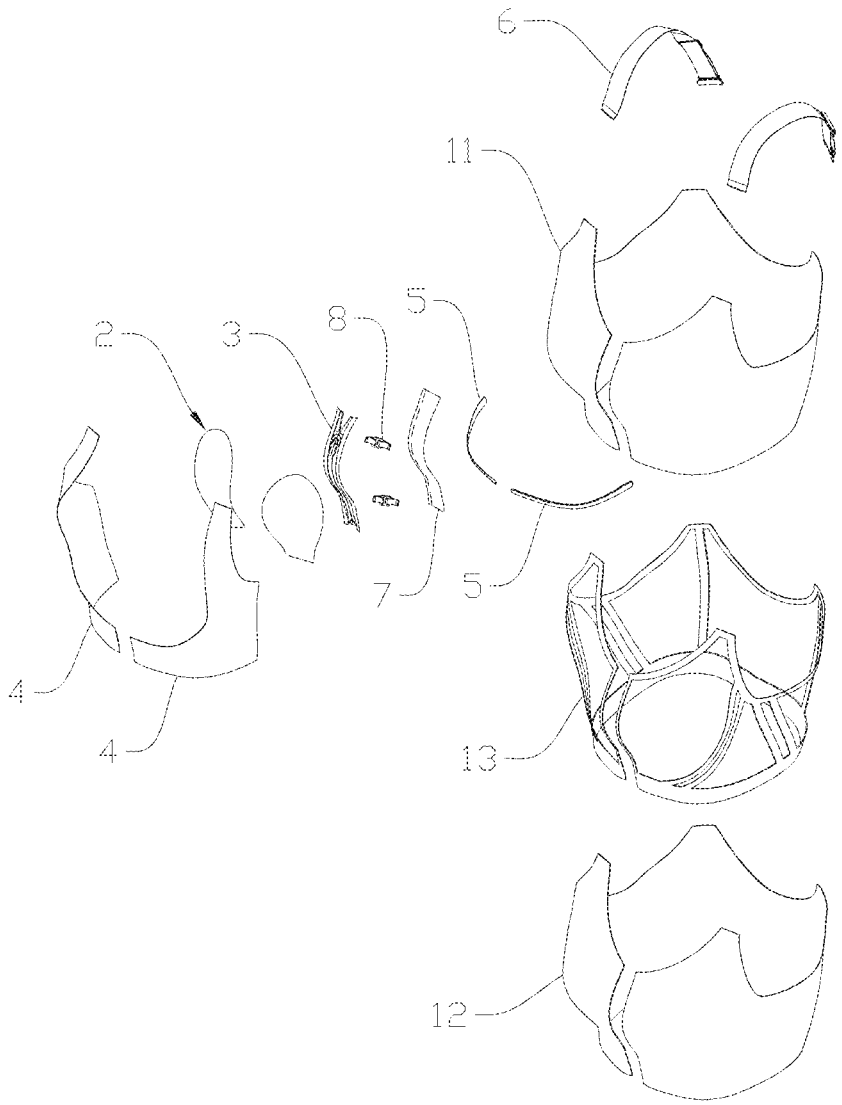
FIG. 3 is a schematic exploded diagram of the undergarment according to an embodiment of the present application.
Figure 4:
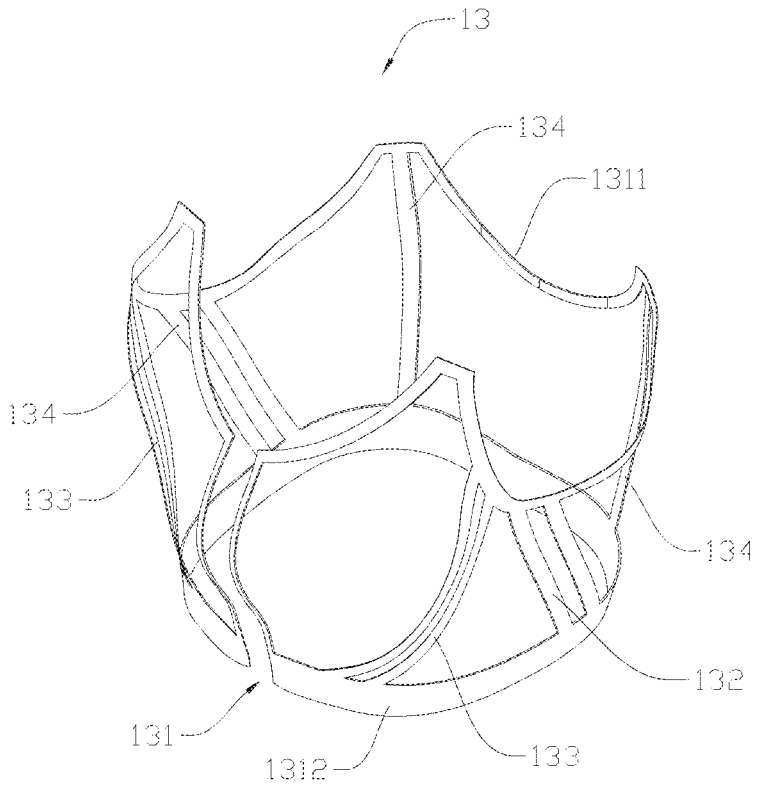
FIG. 4 is a schematic structural diagram illustrating a perspective view of the elastic adhesive layer according to an embodiment of the present application.

With reference to FIGS. 3 and 4, according to this embodiment, the undergarment body 1 adopts a dual-layer fabric structure including a surface elastic fabric 11 and an inner elastic fabric 12. The surface elastic fabric 11 and inner elastic fabric 12 are bonded and fixed through an elastic adhesive layer 13, in certain embodiments, being a jelly adhesive. This configuration allows the elastic adhesive layer 13 to exhibit enhanced elasticity and toughness, enabling better stabilization of breast movement during exercise while maintaining overall thinness and seamlessness of the undergarment. The elastic adhesive layer 13, in certain embodiments, has a thickness ranging from 0.5 mm to 1.5 mm. The compact cups are sandwiched between the surface elastic fabric 11 and the inner elastic fabric 12.

In certain embodiments, the elastic adhesive layer 13 includes a frame portion 131, lateral binding portions 132, arc-shaped lateral support elastic portions 133, and posterior shoulder strap elastic portions 134. The frame portion 131 extends along the edge of the undergarment body 1 and includes an upper elastic edge 1311 and a lower elastic edge 1312. Notably, the lower elastic edge 1312 functionally replaces conventional underband elastic components, eliminating additional underband structures to simplify construction and reduce costs of the undergarment. The lower elastic edge 1312, in certain embodiments, has a width of 15 mm to 40 mm. The posterior shoulder strap elastic portions 134 have upper ends connected to the shoulder strap 6 attachment points of the upper elastic edge 1311 and lower ends connected to the lower elastic edge 1312. This configuration reinforces the structural integrity of the elastic adhesive layer 13, enhances body conformity, and generates backward shoulder-traction forces to elevate breast position. Upper ends of the lateral binding portions 132 are connected to the upper elastic edge 1311; lower ends of the lateral binding portions 132 are connected to the lower elastic edge 1312; and the lateral binding portions 132 are configured in an inclined orientation with upper ends extending toward an anterior chest region and lower ends extending toward a posterior waist region. In such an arrangement, the lower elastic edge 1312 provides lower breast containment, the side support panels 4 deliver vertical lifting, and the angled lateral binding portions 132 generate forward-directed lateral compression forces on the upper breast regions, thereby optimizing lateral shaping efficacy.

In certain embodiments, to enhance the lifting efficacy of the side support panels 4 based on the applications of the side support panels 4, the arc-shaped lateral support elastic portions 133 have upper ends connected to the upper elastic edge 1311 and lower ends connected to the lower elastic edge 1312. The arc-shaped lateral support elastic portions 133 are positioned within the coverage area of the side support panels 4 on the undergarment body 1. The distance between the arc-shaped lateral support elastic portions 133 and the lateral binding portions 132 progressively increases from top to bottom, forming a flared configuration opening downward. Specifically, the upper ends of the arc-shaped lateral support elastic portions 133 and lateral binding portions 132 are proximally spaced (minimal distance), and the lower ends of the arc-shaped lateral support elastic portions 133 and lateral binding portions 132 are distally spaced (maximal distance). This configuration enables the arc-shaped lateral support elastic portions 133 to enhance elasticity at the side support panels 4, thereby improving breast lifting efficacy. Concurrently, through synergistic engagement with the lateral binding portions 132, it generates an integrated lateral compression force that redirects adipose tissue from the waist region toward the cup portions 2, which further enhances the effect of vertical lifting, lateral compression, visual minimization, and tissue convergence performance.

With reference to FIGS. 1 to 3, in this embodiment, the side support panels 4 are similarly constructed from elastic fabric. The side support panels 4 are fixedly attached to the outer surface of the undergarment body 1, in certain embodiments, via adhesive bonding. The positioning stays 5 are fixedly attached to the inner surface of the undergarment body 1 and positioned within the coverage area of the side support panels 4. In certain embodiments, the positioning stays 5 are formed by fabric rolled into strips and stitched to the undergarment body 1. This configuration achieves localized elastic reinforcement through the side support panels 4, generating lateral lifting forces without compromising elastic deformation, while ensuring enhanced aesthetic superiority, improved surface uniformity, and user comfort optimization via the fabric-rolled positioning stays 5, which provide superior tactile response during skin contact and elimination of pressure marks and abrasions. With reference to FIGS. 1 to 3, the upper ends of the side support panels 4 are connected to the shoulder strap 6 attachment points of the undergarment body 1, while their lower ends of the side support panels 4 are connected to the lower edge of the undergarment body 1. The lateral side of the lower end of each side support panel 4 extends to the zipper 3, with the breast-adjacent edge of the side support panel 4 following a curvilinear contour. This configuration establishes a lifting force transmission path where the lifting forces originate inferior to the breast base, follow an arcuate trajectory along the breast periphery, converge at the shoulder strap 6 attachment points. Consequently, the side support panels 4 deliver good support and lifting force to the chest, and it is more comfortable to wear.

It is to be understood that the positioning stays 5 may alternatively be formed through adhesive bonding or integrated interlayer structures to be connected to the undergarment body 1, which is not limited to the specific forms of the positioning stays 5.

Figure 5:
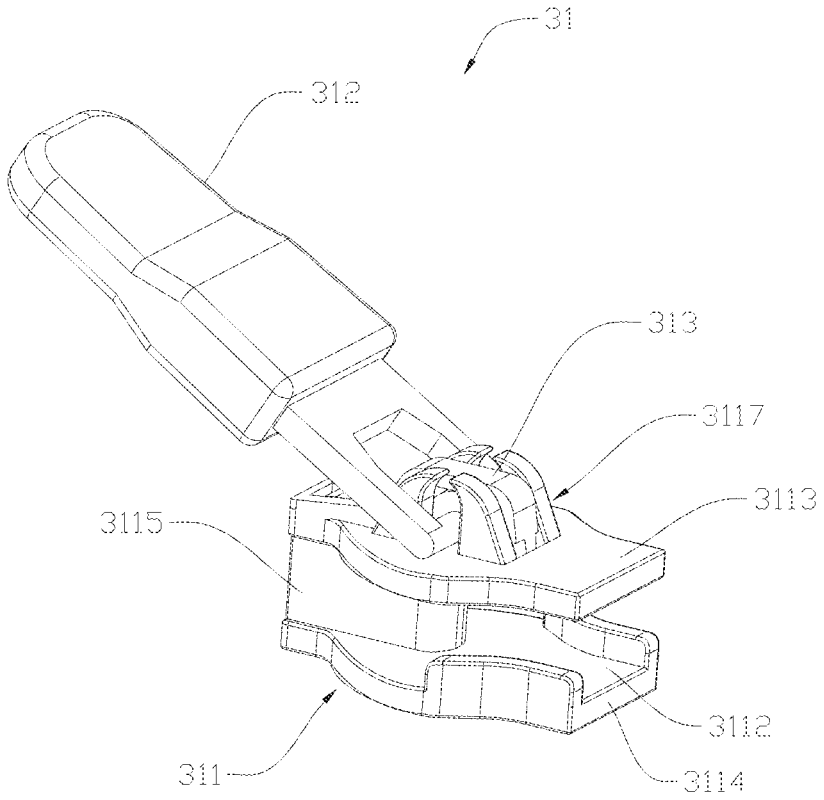
FIG. 5 is a schematic structural diagram illustrating a perspective view of the slider according to an embodiment of the present application.
Figure 6:
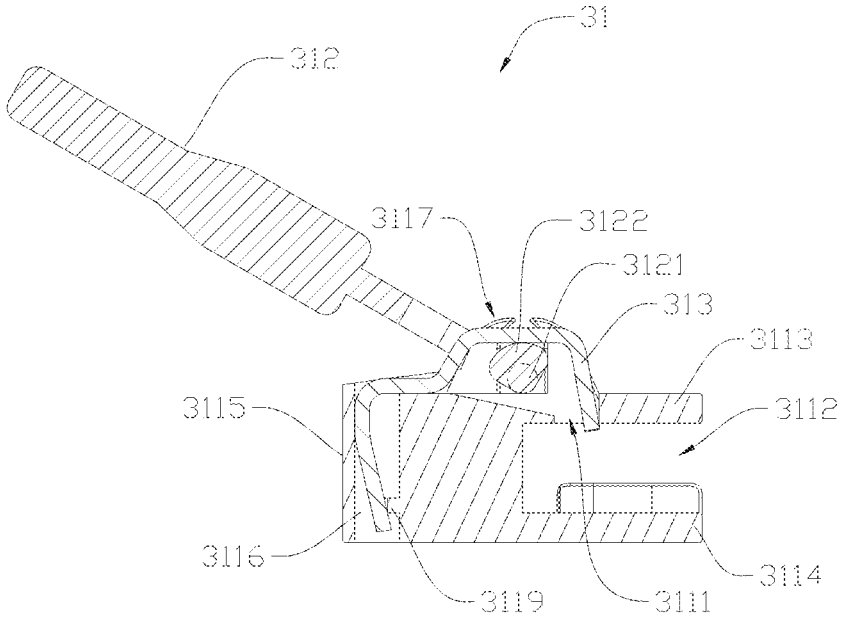
FIG. 6 is a schematic cross-sectional diagram of the slider according to an embodiment of the present application.
Figure 7:
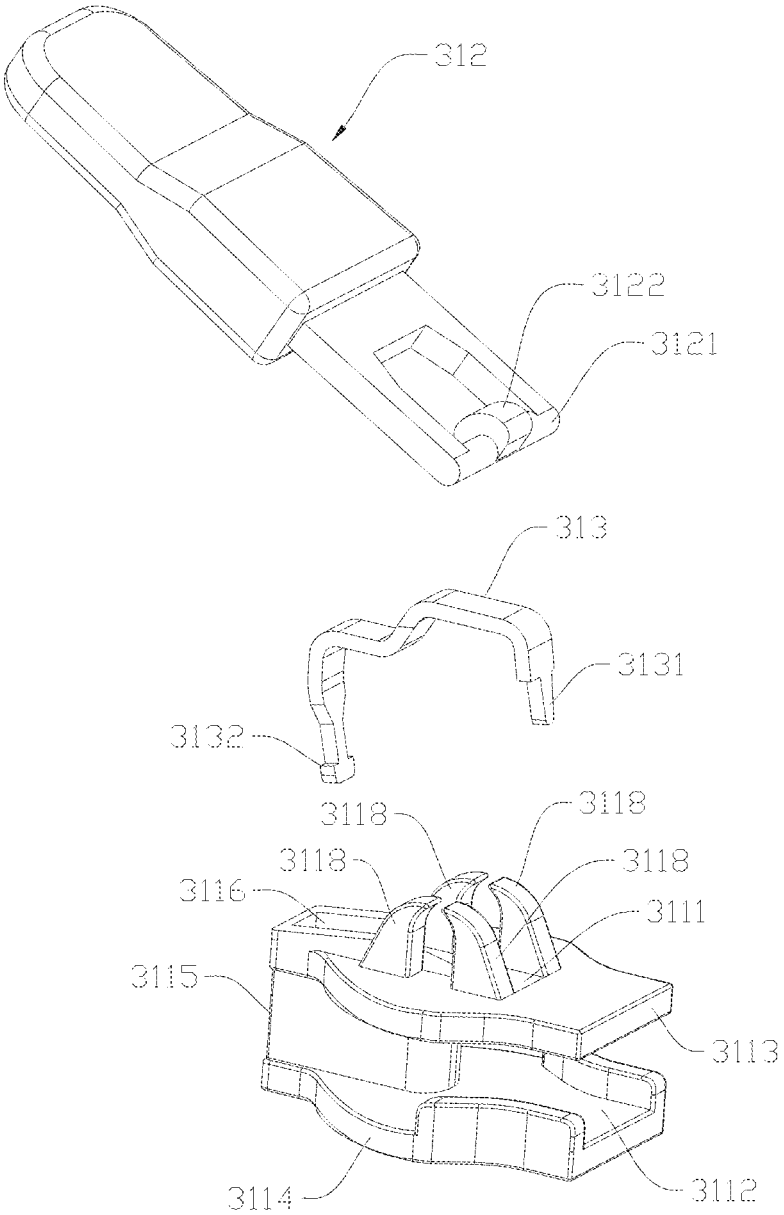
FIG. 7 is a schematic exploded diagram of the slider according to an embodiment of the present application.

With reference to FIGS. 5 to 7, in this embodiment, the zipper 3 adopts a low-profile #5 zipper 3 to prevent bulge formation.

The zipper 3 includes a slider 31 and two zipper straps respectively stitch-bonded to the undergarment body 1. The slider 31 is configured to engage/disengage the zipper teeth of both zipper straps. The zipper teeth of the zipper straps are, in certain embodiments, interior-facing, ensuring concealed engagement when closed to enhance the aesthetics.

The slider 31 includes a slider body 311 a pull tab 312, and a locking element 313. The slider body 311 is provided with a through-hole 3111 and a Y-shaped channel 3112 for zipper strap passage. The through-hole 3111 fluidly communicates with the Y-shaped channel 3112. Specifically, the slider body 311 includes a first wing plate 3113, a second wing plate 3114, and a guide post 3115 interconnecting the frontal ends of the first and second wing plates to form the Y-shaped channel 3112. A slot 3116 is formed on the guide post 3115, a through-hole 3111 is disposed on the first wing plate 3113, and dual constraint assemblies 3117 are spaced apart on the first wing plate 3113, each including two opposing constraint prongs 3118 with elastically converged upper ends, which is configured to constrain rotational mounting of the pull tab 312 on the slider body 311.

In certain embodiments, the pull tab 312 is configured as a planar structure. The pull tab 312 is provided with a pivot shaft 3121 with eccentric protrusion 3122. The pivot shaft 3121 is rotational provided on the slider body 311. Specifically, the pivot shaft 3121 is threaded between the two constraint prongs 3118 of each constraint assembly 3117. The elastically converged upper ends of the constraint prongs 3118 prevent axial disengagement of the pivot shaft 3121, which facilitate installation of the pull tab 312 onto the slider body 311, providing simple construction and low costs, thereby being conducive to controlling the overall thickness of the zipper 3.

The locking element 313 includes elastically deformable body with multi-fold configuration. An end of the locking element 313 is connected to the slider body 311. Specifically, an end of the locking element 313 is inserted into the slot 3116 forming a fixed connection. In certain embodiments, an end of the locking element 313 is provided with a T-shaped foot 3132, and bayonet groove 3119 is provided within the slot 3116. The T-shaped foot 3132 is embedded into the bayonet groove 3119 when the locking element 313 is inserted into the slot 3116, so as to achieve the fixation. An opposite end of the locking element 313 is provided with a locking prong 3131 traversing the through-hole 3111. The locking prong 3131 is configured to engage/disengage with the zipper straps. The locking element 313 is located between two constraint assemblies 3117 to constrain displacement of the locking element 313. The eccentric protrusion 3122 on pull tab 312 is able to cooperate with the locking element 313, and when the pull tab 312 is rotated to a preset angle relative to the slider body 311, the eccentric protrusion 3122 resiliently deforms against the locking element 313 to allow the locking prong 3131 to disengage from the zipper straps so as to realize unlocking.

The preset angle is configurable according to operational requirements, in certain embodiments, ranging from 30° to 90°, with reference to the orientation in the scenario in which the user wears the undergarment. When the pull tab 312 is in a state of downward rotation affixed to the first wing plate 3113 of the slider body 311, the locking element 313 causes the locking prong 3131 to be inserted into the zipper straps to form a lock (specifically, the locking prong 3131 may be inserted into the zipper teeth of one of the zipper straps) by the action of the elastic reset force to realize a self-locking to ensure that the undergarment will not fall apart. At the same time, the locking element 313 provides a reaction force for the pull tab 312, so that the pull tab 312 stays attached to the first wing plate 3113 to ensure the flatness of the inner surface; when the pull tab 312 is rotated upward, with the rotation of the pull tab 312, the eccentric protrusion 3122 gradually pushes against the locking element 313 to elastically deform, until the pull tab 312 is rotated to a preset angle (e.g., 45°) with respect to the slider body 311 so that the locking prong 3131 is disengaged from the zipper straps to form an unlocking. At this point, the pull tab 312 can be pulled to cause the slider 31 to operate the zipper teeth of the two zipper straps to engage or disengage. Of course, it can be understood that the pull tab 312 can remain in the unlocked state for a certain range after the rotation angle of the pull tab 312 exceeds the preset angle.

In this way, compared to the self-locking zippers of the prior art, the overall structure of the zipper 3 solution described above is simpler and lower in cost, and it is easy to control the overall thickness of the zipper 3 to meet the overall flatness of the undergarment.

The technical means disclosed in the solution of the present disclosure are not limited to those disclosed in the embodiments mentioned above but also include technical solutions consisting of any combination of the above technical features. It should be noted that for those skilled in the art, multiple improvements and modifications may be made without departing from the principles of the present disclosure. These improvements and modifications are also considered to be within the scope of protection of the present disclosure.

The invention claimed is:

1. An undergarment for a wearer, comprising:

an undergarment body made of elastic fabric, the undergarment body being provided with two cup portions;

a zipper disposed on the undergarment body and positioned between the two cup portions, the zipper when unfastened being configured to open the undergarment body;

side support panels configured to provide lateral lifting force, the side support panels disposed on the undergarment body and positioned at outer peripheries of the cup portions; and two positioning stays, located on a front of the undergarment body under the cup portion for supporting each one of a wearer's breasts, configured to provide a lower periphery constraint to each cup of the wearer's undergarment to retain each of a wearer's breasts.

2. The undergarment according to claim 1, wherein the side support panels are made of elastic fabric, and the side support panels are fixedly attached to an outer surface of the undergarment body.

3. The undergarment according to claim 2, wherein the side support panels are glued to the undergarment body.

4. The undergarment according to claim 2, wherein upper ends of the side support panels are connected to shoulder straps of the undergarment body: lower ends of the side support panels are connected to a lower edge of the undergarment body; and a lateral side of the lower ends of the side support panels extends to the zipper.

5. The undergarment according to claim 4, wherein an edge of the side support panels proximate to the cup portions extends in a curvilinear contour.

6. The undergarment according to claim 1, wherein the positioning stays are fixedly attached to an inner surface of the undergarment body, and the positioning stays are positioned within a coverage area of the side support panels on the undergarment body.

7. The undergarment according to claim 1, wherein the undergarment body comprises a surface elastic fabric and an inner elastic fabric, the surface elastic fabric and inner elastic fabric being adhesively bonded via an elastic adhesive layer; the elastic adhesive layer comprises a frame portion and lateral binding portions; the frame portion extends along an edge of the undergarment body and comprises an upper elastic edge and a lower elastic edge; upper ends of the lateral binding portions are connected to the upper elastic edge; lower ends of the lateral binding portions are connected to the lower elastic edge; and the lateral binding portions are configured in an inclined orientation with upper ends extending toward an anterior chest region and lower ends extending toward a posterior waist region.

8. The undergarment according to claim 7, wherein the elastic adhesive layer further comprises arc-shaped lateral support elastic portions; upper ends of the arc-shaped lateral support elastic portions are connected to the upper elastic edge; lower ends of the arc-shaped lateral support elastic portions are connected to the lower elastic edge; and the arc-shaped lateral support elastic portions are positioned within a coverage area of the side support panels on the undergarment body.

9. The undergarment according to claim 7, wherein the elastic adhesive layer further comprises posterior shoulder strap elastic portions; upper ends of the posterior shoulder strap elastic portions are connected to the shoulder straps of the upper elastic edge; and lower ends of the posterior shoulder strap elastic portions are connected to the lower elastic edge.

10. The undergarment according to claim 1, further comprising: an inner padding positioned inward of the zipper, a lateral edge of the inner padding being connected to a side of the undergarment body at the zipper.

11. The undergarment according to claim 10, further comprising: an adjustment buckle connected to the undergarment body and positioned between the zipper and the inner padding.

12. The undergarment according to claim 1, wherein the zipper comprises a slider and two zipper straps, the two zipper straps are respectively connected to the undergarment body, the slider is configured to operate engagement/disengagement of zipper teeth of the two zipper straps, the slider comprises a slider body provided with a through-hole and a Y-shaped channel for passage of the zipper straps, the through-hole is in fluid communication with the Y-shaped channel; a pull tab is provided with a pivot shaft rotationally mounted on the slider body, the pivot shaft is provided with an eccentric protrusion, a locking element is elastically deformable, an end of the locking element is connected to the slider body, an opposite end of the locking element is provided with a locking prong traversing the through-hole, the locking prong is configured to engage/disengage the zipper straps, and the eccentric protrusion pushes against the locking element to induce elastic deformation of the locking element to disengage the locking prong from the zipper straps thereby achieving unlocking upon rotation of the pull tab relative to the slider body to a preset angle.

13. The undergarment according to claim 12, wherein the slider body comprises a first wing plate, a second wing plate, and a guide post connecting frontal ends of the first wing plate and the second wing plate to form the Y-shaped channel; the guide post is provided with a slot for insertion and fixed connection of an end of the locking element; the through-hole is disposed on the first wing plate; the first wing plate is further provided with two spaced constraint assemblies for constraining the pivot shaft; the locking element is positioned between the two constraint assemblies; each constraint assembly comprises two constraint prongs spaced apart; the pivot shaft is threaded between the two constraint prongs of each constraint assembly; and upper ends of the two constraint prongs are elastically converged to restrict disengagement of the pivot shaft.

* * * * *